US009855176B2

(12) United States Patent
Roussy et al.

(10) Patent No.: US 9,855,176 B2
(45) Date of Patent: Jan. 2, 2018

(54) PATIENT SUPPORT GUARD STRUCTURE

(71) Applicant: Stryker Corporation, Kalamazoo, MI (US)

(72) Inventors: Richard B. Roussy, London (CA); Jason Connell, London (CA); Christopher George, St. Thomas (CA); Christopher Jacob, London (CA)

(73) Assignee: Stryker Corporation, Kalamazoo, MI (US)

( * ) Notice: Subject to any disclaimer, the term of this patent is extended or adjusted under 35 U.S.C. 154(b) by 321 days.

(21) Appl. No.: 14/391,469

(22) PCT Filed: Apr. 12, 2013

(86) PCT No.: PCT/CA2013/000354

§ 371 (c)(1),
(2) Date: Oct. 9, 2014

(87) PCT Pub. No.: WO2013/152438

PCT Pub. Date: Oct. 17, 2013

(65) Prior Publication Data

US 2015/0164722 A1 Jun. 18, 2015

Related U.S. Application Data

(60) Provisional application No. 61/623,559, filed on Apr. 12, 2012.

(51) Int. Cl.
*A61G 7/05* (2006.01)
*A61G 7/005* (2006.01)
(Continued)

(52) U.S. Cl.
CPC ..... *A61G 7/0507* (2013.01); *A61G 7/052* (2016.11); *A61G 7/0509* (2016.11);
(Continued)

(58) Field of Classification Search
CPC ..... A61G 7/012; A61G 7/0507; A61G 2007/0509; A61G 2007/051;
(Continued)

(56) References Cited

U.S. PATENT DOCUMENTS 4,511,171 A * 4/1985 Petersen ..... A61G 3/0808 188/2 F
4,998,939 A * 3/1991 Potthast ..... A61G 7/0507 5/424

(Continued)

FOREIGN PATENT DOCUMENTS

DE 3112715 A1 10/1982
GB 2155778 B 9/1987

(Continued)

OTHER PUBLICATIONS

International Search Report and Written Opinion of the International Searching Authority (PCT/CA2012/000354) dated Jul. 19, 2013.

(Continued)

*Primary Examiner* — Nicholas F Polito

(57) ABSTRACT

A guard structure of a patient support, such as a hospital bed, is electrically unlockable. An electromechanical actuator, such as a solenoid, may be used to electrically unlock the guard structure. The guard structure may also be mechanically unlockable. The guard structure may automatically unlock during a CPR emergency. A maximum allowable height of the patient support may be adjusted based on a sensed locked state or position of the guard structure. A release for the guard structure may be positioned to be accessible to an occupant of the patient support. The release may include an access port that may be opened. The release may include a button that electrically unlocks the guard structure.

19 Claims, 12 Drawing Sheets

(51) Int. Cl.
*A61G 7/015* (2006.01)
*A61G 7/018* (2006.01)

(52) U.S. Cl.
CPC ..... *A61G 7/0514* (2016.11); *A61G 7/0516* (2016.11); *A61G 7/0524* (2016.11); *A61G 7/005* (2013.01); *A61G 7/015* (2013.01); *A61G 7/018* (2013.01)

(58) Field of Classification Search
CPC .... A61G 2007/0514; A61G 2007/0516; A61G 2007/052; A61G 2007/0524; A61G 2203/40; A61G 2203/70; A61G 2203/72; A61G 2203/726; A61G 7/005; A61G 7/015; A61G 7/018
See application file for complete search history.

(56) References Cited

U.S. PATENT DOCUMENTS 6,000,076 A * 12/1999 Webster ..... A61G 7/015 5/600
6,182,310 B1 2/2001 Weismiller et al.
6,487,735 B1 * 12/2002 Jacques, II ..... A47D 7/02 5/424
6,938,289 B2 9/2005 Morin
7,082,630 B2 8/2006 Castonguay et al.
7,107,637 B2 9/2006 Kuek et al.
7,690,059 B2 4/2010 Lemire et al.
7,712,166 B2 5/2010 Stryker et al.
7,836,531 B2 11/2010 Girard et al.
8,104,118 B2 1/2012 Derenne et al.
8,844,076 B2 9/2014 Becker et al.
2009/0188042 A1 * 7/2009 Derenne ..... A61G 7/0507 5/430
2009/0200838 A1 * 8/2009 Cone, II ..... B62B 7/068 297/16.2
2009/0229051 A1 * 9/2009 Heimbrock ..... A61G 7/0507 5/430
2012/0047652 A1 * 3/2012 Metz ..... A61G 7/0507 5/428
2013/0086746 A1 * 4/2013 Vanderpohl ..... A61G 7/0507 5/428

FOREIGN PATENT DOCUMENTS

GB 2447500 B 9/2008
WO WO 2007075701 A2 * 7/2007 ..... A61G 7/005

OTHER PUBLICATIONS

European Search Report dated Mar. 2, 2016, for European patent application EP 13776135, corresponding to U.S. Appl. No. 14/391,469.

* cited by examiner

PATIENT SUPPORT GUARD STRUCTURE

CROSS-REFERENCE TO RELATED APPLICATIONS

This application is a §371 national entry of PCT/CA2013/000354, filed Apr. 12, 2013, which claims the benefit of U.S. patent application 61/623,559, filed Apr. 12, 2012, the entirety of which are incorporated herein by reference.

FIELD OF THE INVENTION

This disclosure relates to patient supports, such as hospital beds, and more specifically, patient supports having a movable guard structure, such as a side rail.

BACKGROUND

Patient supports, such as hospital beds, are known to have guard structures, such as side rails, that are movable to permit patient entry and egress from the patient support; for example, they may be raised and lowered. Side rails are known to be mechanically lockable. When a typical side rail is locked, it cannot be moved.

Side rail locking mechanisms are limited in how they can be unlocked. This may lead to inconvenience when operating the patient support. For example, typical locking structures or locking mechanisms are operable only from outside the patient support or bed by a caregiver or attendant; this makes it difficult for patients to exit the bed once the rails have been raised without calling for help. This may be inconvenient in some situations, for example when a patient needs to quickly use a restroom or in maternity wards where an infant is present in the bed along with the patient. In addition, during a medical emergency, this may be dangerous if patient access is required quickly and the each rail needs to be manually unlocked by an attendant.

Side rails may also be lowered at times when they would better be left raised, such as when the patient support is adjusted to a high height or while the patient support is being lowered to a low height near the floor. This may be dangerous to the occupant of the patient support, due to the danger of falling out of the bed, or may damage side rails due to impact with the floor when the bed is lowered. Existing patient supports typically do not include patient support control mechanisms that determine the locking state and/or rail position in conjunction with other variables, such as bed height, or locking mechanisms that facilitate this determination.

There is therefore a need for improved patient supports, side rails and/or side rail unlocking mechanisms to mitigate some or all of these deficiencies.

SUMMARY OF THE INVENTION

A guard structure of a patient support includes a locking structure that is mechanically unlockable. A release for the locking structure may be positioned to be accessible to an occupant of the patient support. The release may include an access port that may be opened. The locking structure may additionally or alternatively be electrically unlockable. The release may include a button that electrically unlocks the guard structure. A solenoid may be used to electrically unlock the guard structure and may optionally be coupled with a locking structure that mechanically maintains the guard structure in an unlocked state. One or more guard structures may automatically unlock during a CPR emergency. A maximum or minimum allowable height of the patient support may be adjusted based on a sensed locked state and/or a sensed position of the guard structure. Other aspects of the guard structure are also disclosed.

BRIEF DESCRIPTION OF THE DRAWINGS

The drawings illustrate, by way of example only, embodiments of the present disclosure.

DETAILED DESCRIPTION

As used herein, the term "patient support" refers to an apparatus for supporting a patient in an elevated position relative to a support surface for the apparatus, such as a floor. One embodiment of a patient support includes beds, for example hospital beds for use in supporting patients in a hospital environment. Other embodiments may be conceived by those skilled in the art. The exemplary term "hospital bed" or simply "bed" may be used interchangeably with "patient support" herein without limiting the generality of the disclosure.

As used herein, the term "guard structure" refers to an apparatus mountable to or integral with a patient support that prevents or interferes with egress of an occupant of the patient support from the patient support, particularly egress in an unintended manner. Guard structures are often movable to selectively permit egress of an occupant of the patient support and are usually located about the periphery of the bed, for example on a side of the bed. One embodiment of a guard structure includes rails, for example side rails, mountable to a side of a patient support, such as a hospital bed. Other embodiments may be conceived by those skilled in the art. The exemplary terms "guard rail", "side rail", "rail structure", or simply "rail" may be used interchangeably with "guard structure" herein without limiting the generality of the disclosure.

As used herein, the term "control circuit" refers to an analog or digital electronic circuit with inputs corresponding to a patient support status or sensed condition and outputs effective to cause changes in the patient support status or a patient support condition. For example, a control circuit may comprise an input comprising an actuator position sensor and an output effective to change actuator position. One embodiment of a control circuit may comprise a programmable digital controller, optionally comprising or interfaced with an electronic memory module and an input/output (I/O) interface. Other embodiments may be conceived by those skilled in the art. The exemplary terms "controller", "control system", "control structure" and the like may be used interchangeably with "control circuit" herein without limiting the generality of the disclosure.

Figure 1:
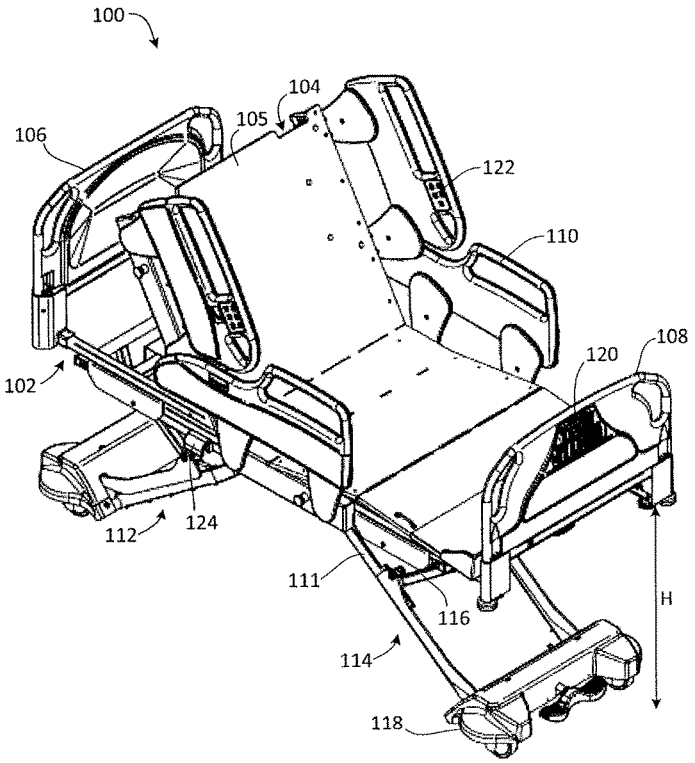
FIG. 1 is a perspective view of a patient support.

FIG. 1 illustrates an embodiment of a height-adjustable patient support 100. The patient support 100 includes a substantially horizontal frame 102 that supports an adjustable patient support deck 104 (or simply "deck") positioned thereon to receive a patient support surface (or "mattress") for supporting a patient thereon. For clarity, the mattress is not illustrated. The patient support deck 104 has an upper-body portion 105 capable of tilting up to form a backrest and tilting down to a prone position (tilt-up position shown). At the head end of the patient support 100 is a headboard 106, while a foot-board 108 is attached to the frame 102 at the foot end of the patient support 100. Guard structures comprising side rails 110 are positioned on each side of the patient support 100. Such side rails 110 may be moveable so as to facilitate entry and exit of a person. In this embodiment, the patient support 100 is a bed. In other embodiments, the patient support 100 may be a chair, wheelchair, stretcher, or similar apparatus. The term "patient" is intended to refer to any person, such as a hospital patient, nursing-home resident, or any other occupant of the patient support 100.

The patient support 100 includes two leg assemblies 112, 114, each having a pair of legs 111. The head leg assembly 112 is connected at the head end of the patient support 100 and the foot leg assembly 114 is connected at the foot end of the patient support 100. Upper portions of the legs 111 of the leg assemblies 112, 114 are connected to one or more linear actuators that may move the upper portions of the legs 111 back and forth along the length of the patient support 100. Leg braces 116 pivotably connected to the legs 111 and to the frame 102 constrain the actuator movement applied to the legs 111 to move the leg assemblies 112, 114 in a manner that raises and lowers the frame 102. In other words, the leg assemblies 112, 114 act as linkages that collapse and expand to respectively lower and raise the frame 102, whose height is indicated by H. The lower ends of the leg assemblies 112, 114 are connected to caster assemblies 118 that allow the patient support 100 to be moved to different locations.

Articulation of the patient support deck 104 is controlled by actuators (not shown) that adjust the tilt of the upper-body portion 105 of the patient support deck 104 as well as the height of a knee-supporting portion of the patient support deck 104.

A manual cardiopulmonary resuscitation (CPR) quick release handle 124 is provided on each side of the patient support 100 to rapidly lower the upper-body portion 105 of the patient support deck 104 and place the bed into an emergency state wherein the patient support deck 104 is flat and optionally the side rails are unlocked. This will be discussed in further detail below.

The patient support 100 further includes an attendant's control panel 120 located at the foot-board 108. The attendant's control panel 120 may, among other things, control the height H of the frame 102, as well as the articulation of the patient support deck 104. To allow for similar adjustment, an occupant's control panel 122 may be provided, for example, on a side rail 110.

The control panels 120, 122 include user interfaces such as buttons. The buttons may be membrane style buttons that operate as momentary contact switches (also known as "hold-to-run" switches). Buttons may be provided to raise the frame 102, lower the frame, articular the patient support deck 104, set/pause/reset an exit alarm, zero an occupant weight reading, lockout controls, and to enable other functions. The control panels 120, 122 may have different sets of buttons for different sets of functions, with the attendant's control panel 120 typically having a wider array of functions available. Other styles of user interface and buttons, such as touch-screen buttons, are also suitable. The user interfaces of the control panels 120, 122 may include indicators, such as printed graphics or graphics on a display, for describing the functions of the buttons or other interface and as well as indicating data related to the patient support 100.

It should be emphasized that the patient support 100 is merely one example of a patient support that may be used with the techniques described herein. Other examples of patient supports that may be so used include ultra-low type height-adjustable beds such as those disclosed in US Patent Publication No. 2011/113556 and U.S. Pat. No. 7,003,828, which are both incorporated herein by reference.

Figure 2:
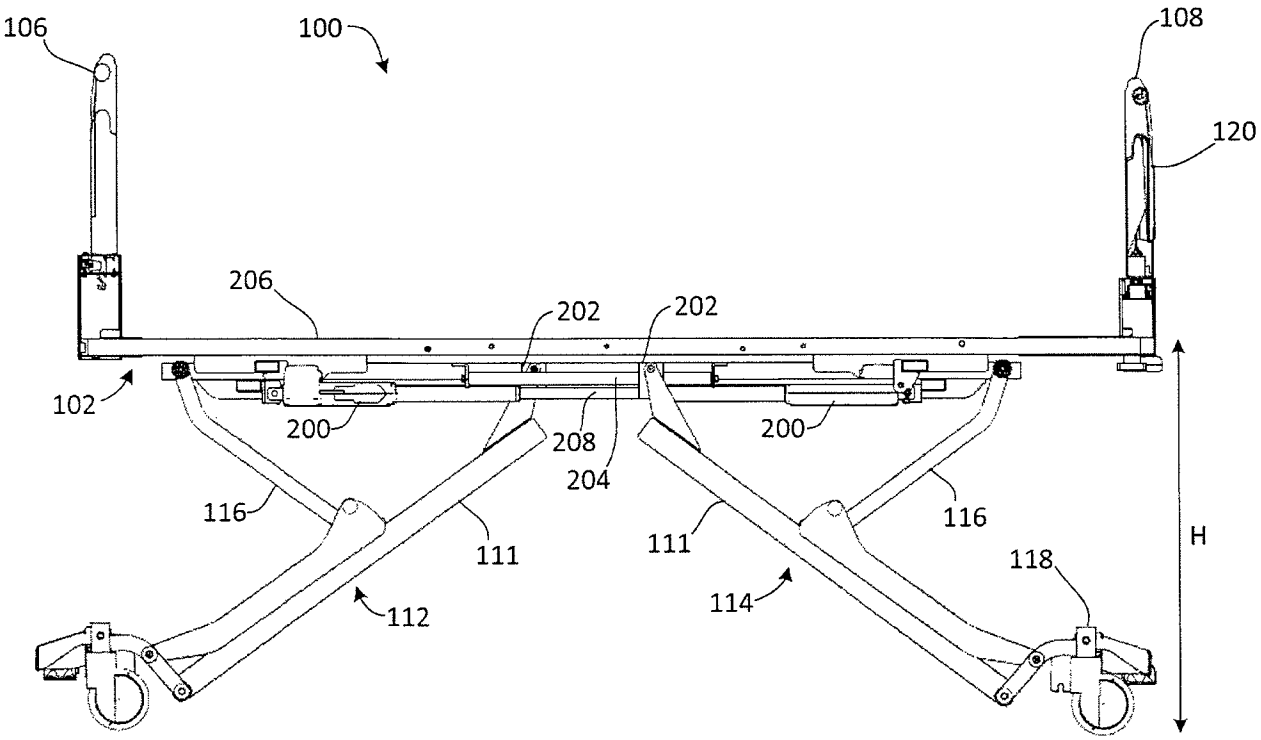
FIG. 2 is a side view of the patient support.

As shown in FIG. 2, one or more linear actuators 200 are provided to the leg assemblies 112, 114. Each linear actuator 200 has an extendable/retractable rod 208 that is connected to a bearing block 202, which slidably engages with a respective guide rod 204. The guide rods 204 are fixed to the frame 102. The upper portions of the legs 111 of each of the leg assemblies 112, 114 are pivotably connected to the respective bearing block 202. When the actuators 200 extend and retract, the bearing blocks 202 move linearly along the lengths the guide rods 204. This linear motion is converted, via the additional constraint of the pivot-connected leg braces 116, to motion that raises and lowers the frame 102. Also illustrated is one of the elongate structural members 206 that, together with cross-members (not shown), form the frame 102. Although in this embodiment the patient support 100 has two actuators 200 for raising and lowering the frame 102, it should be understood that one or more actuators 200 may be used.

Each actuator 200 may include an actuator position sensor that may output a signal indicative of the position of the actuator 200 and thus the height of the frame 102 above the floor. For instance, the actuator position sensor may be a digital rotary encoder that outputs pulses to a control circuit that may comprise a programmable digital controller, which may count the pulses to determine the position of the bearing block 202 and may further lookup or calculate a height of the frame 102 based on this count. A single actuator position sensor may be indicative of frame height when more than one actuator 200 is used. In other examples, other kinds of position or height sensors may be used and these need not be included in the actuator.

The actuators 200 may also be configured to move the patient support 100 into other positions, such as the Trendelenburg position (head lower than foot) or the reverse Trendelenburg position (head higher than foot).

Figure 3:
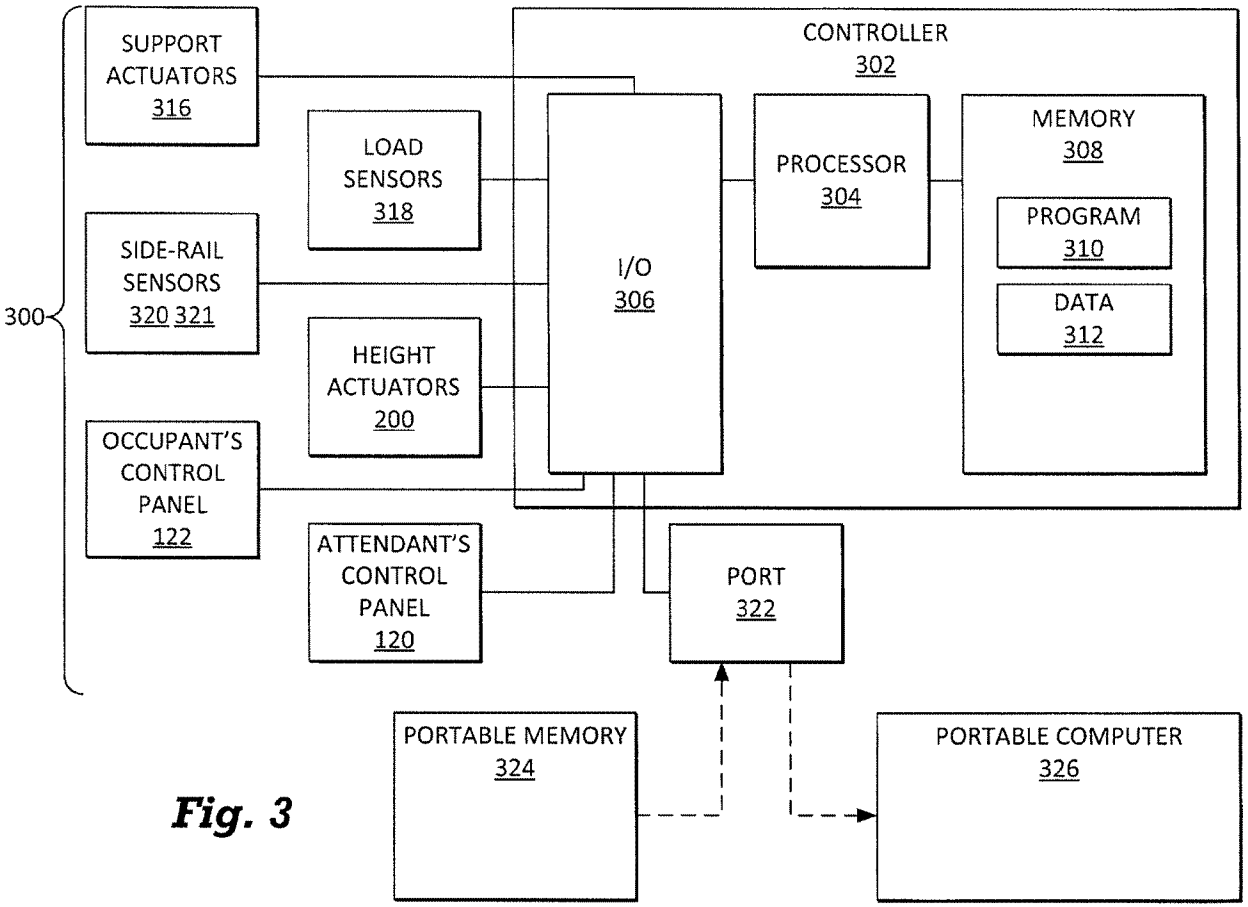
FIG. 3 is a functional block diagram of a system for controlling the patient support.

FIG. 3 shows a block diagram of a system 300 for controlling the patient support 100. Each of the components of the system 300 may be attached to the patient support 100 at a suitable location.

The system 300 includes a controller 302 that includes a processor 304 electrically coupled to an input/output interface 306 and memory 308. The controller 302 may be situated in a control box that is attached or otherwise coupled to the patient support 100. The controller 302 may be physically integrated with another component of the system 300, such as the attendant's control panel 120.

The processor 304 may be a microprocessor, such as the kind commercially available from Freescale™ Semiconductor. The processor 304 may be a single processor or a group of processors that cooperate. The processor 304 may be a multicore processor. The processor 304 is capable of executing instructions obtained from the memory 308 and communicating with the input/output interface 306.

The memory 308 may include one or more of flash memory, dynamic random-access memory, read-only memory, and the like. In addition, the memory 308 may include a hard drive. The memory 308 is capable of storing data and instructions for the processor 304. Examples of instructions include compiled program code, such as a binary executable, that is directly executable by the processor 304 and interpreted program code, such as Java® bytecode, that is compiled by the processor 304 into directly executable instructions. Instructions may take the form programmatic entities such as programs, routines, subroutines, classes, objects, modules, and the like, and such entities will be referred to herein as programs, for the sake of simplicity. The memory 308 may retain at least some of the instructions stored therein without power.

The memory 308 stores a program 310 executable by the processor 304 to control operations of the patient support 100. The controller 302 comprising the processor 304 executing the program 310, which configures the processor 304 to perform actions described with reference to the program 310 may control, for example, the height of the frame 102, articulation of the patient support deck 104 (e.g., upper-body tilt and knee height), exit alarm settings, and the like. The controller 302 may also be configured to obtain operational data from the patient support 100, as will be discussed below. Operational data obtained by the controller 302 may be used by the processor 304 and program 310 to determine control limits for the patient support 100.

The memory 308 also stores data 312 accessible by the processor 304. The data 312 may include data related to the execution of the program 310, such as temporary working data. The data 312 may additionally or alternatively include data related to properties of the patient support 100, such as a patient support serial number, model number, MAC address, IP address, feature set, current configuration, and the like. The data 312 may additionally or alternatively include operational data obtained from components, such as sensors and actuators, of the patient support 100. Operational data may include the height of the frame 102, an articulated state of the patient support deck 104, a status of the side rails 110, an exit alarm setting or status, and an occupant weight. The data 312 may include historic data, which may be time-stamped. For example, the occupant's weight may be recorded several times a day in association with a timestamp. The data 312 may be stored in variables, data structures, files, data tables, databases, or the like. Any or all of the data mentioned above may be considered as being related to the patient support 100.

The input/output interface 306 is configured to communicate information between the processor 304 and components of the system 300 outside the controller 302. The communication may be in the form of a discrete signal, an analog signal, a serial communication signal, or the like. The input/output interface 306 may include one or more analog-to-digital converters.

In one embodiment, the input/output interface 306 allows the processor 304 to send control signals to the other components of the system 300 and to receive data signals from these components in what may be known as a master-slave arrangement.

The system 300 further includes components, such as one or more actuators 316 configured to control the articulation of the patient support deck 104, one or more load sensors 318 (e.g., load cells) positioned to measure the weight of the occupant of the patient support 100, one or more side-rail sensors 320, 321 configured to sense the position and/or locked state of a side rail 110, the frame-height actuators 200, the occupant's control panel 122, and the attendant's control panel 120. Each of the components may receive control signals from the controller 302, send data signals to the controller 302, or both.

In this embodiment, the controller 302 includes the input/output interface 306 having one or more physical ports 322, such as a universal serial bus (USB) port, a memory card slot, an Ethernet jack, a serial port, or the like. The port 322 includes logic, such as a USB controller or Ethernet adaptor, to allow transfer of data between the controller 302 and a physically connected external device, such as a memory stick, memory card, portable computer, or similar device. Such physical connections may be made by an appropriate cable, such as a USB cable, Ethernet crossover cable, or the like. When the port includes a network interface, standard network protocols may be used. The port 322 accepts a physical connection (e.g., a cable or insertion of a card).

A portable memory device 324, such as a USB memory stick or flash memory card, or an external computer, such as a portable computer 326, may be connected to the port 322 to communicate data with the patient support 100.

Figure 4:
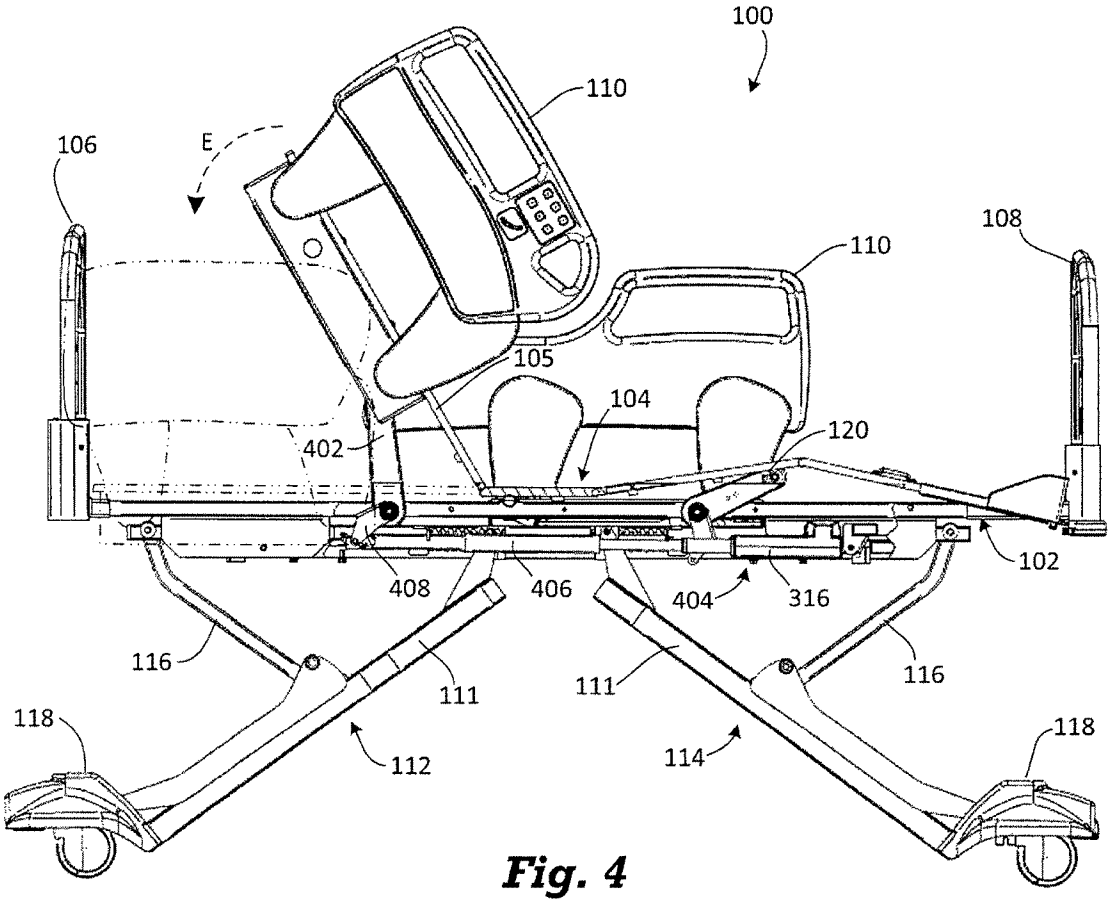
FIG. 4 is a side view of the patient support showing activation of a CPR mechanism.

As mentioned, the upper-body portion or backrest 105 of the patient support deck 104 is variably positionable, and accordingly may be raised and lowered so that the occupant of the patient support 100 may be provided with, for example, a range of positions between fully prone and sitting upright. As shown in FIG. 4, a backrest support 402 is pivotably connected to the frame 102 and supports the backrest 105 over its range of positions.

A backrest actuator assembly 404 is connected between the backrest 105 and the frame 102 and is configured to raise and lower the backrest 105 with respect to the frame 102. In this example, the backrest actuator assembly 404 includes an actuator 316, which is connected to the frame 102. The backrest actuator assembly 404 further includes a lockable damper 406 that is connected in series with the actuator 316 at one end and is pivotably connected to a lever arm 408 extending from the backrest support 402 at another end. The lever arm 408 may also be known as a head gatch bracket. The CPR handle 124 operates with the above components to form an emergency CPR mechanism.

The actuator 316 may be an electric motor-driven linear actuator.

The lockable damper 406 may be a lockable fluid-filled damper, such as a locking hydraulic damper, locking gas spring, or the like. The lockable damper 406 is configured to provide damping over a range of motion when unlocked and configured to rigidly or nearly rigidly lock at any position on the range of motion. For the linear style damper described herein, range of motion may be known as damper stroke. Dampers may also be known as dampeners or dashpots.

In one example, the lockable damper 406 includes a cylindrical body though which a piston slides. Each side of the piston has a chamber of fluid that is selectively communicated by pushing an unlocking pin that opens a valve in the piston to allow fluid to move between the chambers. Relative movement between the cylindrical body and a rod extending from the piston may then be damped (valve open) or held rigid (valve closed). In other examples, other kinds of dampers may be used. The lockable damper 406 may be a BLOC-O-LIFT™ device sold by Stabilus GmbH of Koblenz, Germany.

Each CPR handle 124 (see FIG. 1) is connected to the lockable damper 406. Each CPR handle 124 is configured to unlock the lockable damper 406 when actuated to an unlock position, thereby allowing the damper 406 to contract without having to operate the actuator 316.

During normal operation of the patient support 100, the lockable damper 406 is locked in an extended state and movement of the actuator 316 causes the lockable damper 406 to push or pull against the lever arm 408 to raise or lower the backrest 105 as commanded by the controller 302 operated by the bed's occupant or an attendant, such as a nurse or caregiver.

During an emergency, such as a cardiac arrest of the bed's occupant, a CPR handle 124 may be manually actuated to quickly allow the backrest 105 to drop due to gravity as shown by arrow E (dropped position shown in phantom line). The rate of drop of the backrest 105 is controlled at least in part by the damping effect of the damper 406 as it contracts over its damped range of motion under the weight of the backrest 105, backrest support 402, attached side rails 110, mattress, the occupant's upper body, and any other items in or on the patient support 100.

After the CPR handle 124 has been actuated and while the backrest 105 is dropping due to gravity, the CPR handle 124 may be returned to its original position, or lock position, to lock the lockable damper 406 at its current length and thereby stop the dropping of the backrest 105. The backrest 105 may be stopped at any position along the damped range of motion, which may make for safer bed operation. For example, if the arm of the occupant or that of a person standing near the hospital bed is under the backrest 105 during a CPR release, the backrest 105 may be temporarily stopped to reduce the chance of injury.

Once the CPR handle 124 is pulled and the emergency mechanism is activated to place the patient support in an emergency state, the goal is to allow caregiver's to perform whatever procedures are required to attend to the immediate needs of the patient. Accordingly, a patient supporting surface of the patient support is made flat when in the emergency state and, optionally, the side rails are unlocked through actuation of the release, permitting them to drop out of the way due to gravity. Other actions may also be performed automatically by the patient support when the emergency mechanism is activated to improve access of the caregiver to the patient or otherwise facilitate emergency care.

Figure 5A:
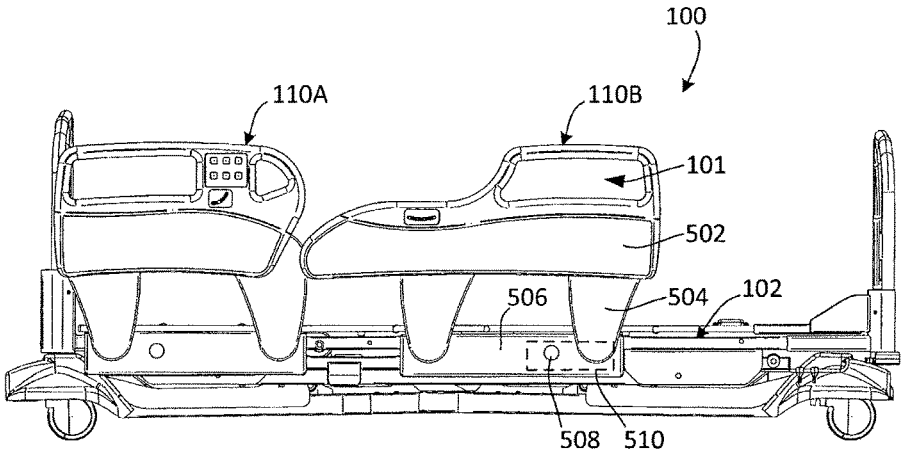
FIGS. 5A-B are side views of the patient support showing different side rail positions.
Figure 5B:
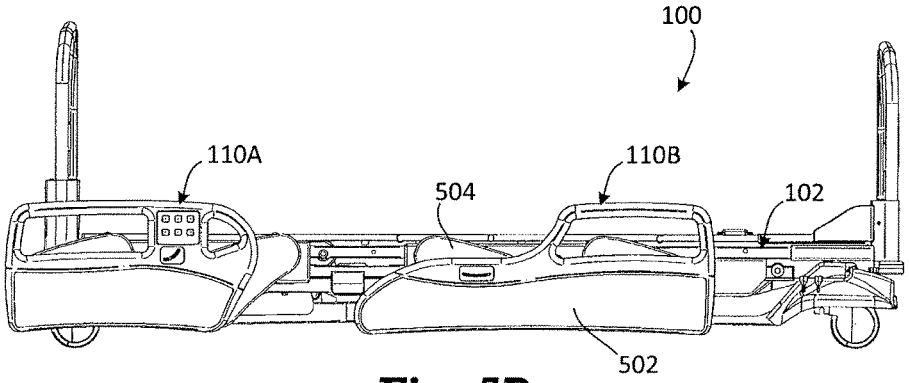

With reference to FIGS. 5A and 5B, which depict the patient support 100 in its lowered position, in this embodiment the patient support 100 has four guard structures in the form of side rails 110 (only two visible in this view). Two head-end side rails 110A are positioned on opposite sides of the patient support 100 near its head end, and two foot-end side rails 110B are positioned on opposite sides of the patient support 100 at about its midsection, but extending toward the foot end of the bed. Although the side rails are shown having an opening 101, in some embodiments this opening may be filled in without affecting function.

Each of the side rails 110A, 110B comprises a side rail body 502 pivotally connected to the upper end of two side rail supports 504. Each side-rail support 504 is pivotally connected to the side rail body 502 and pivotally connected to a side-rail housing 506 configured for mounting the side rail 110 to the frame 102 or backrest 105. The side-rail supports 504 rotate to raise and lower the side rail body 502 with respect to the frame 102, while keeping the side rail body 502 substantially horizontal and parallel to the frame 102 or backrest 105. The side rail body 502, two side-rail supports 504, and side-rail housing 506 may be considered to form a first four-bar linkage. A mechanical release comprising a knob 508 is provided for each side rail 110A, 110B to unlock a locking structure 510 (hidden line) of the side rail 110A, 110B to allow movement of the side rail 110A, 110B.

Each of the side rails 110A, 110B locks when its side rail body 502 is in a raised position, depicted in FIG. 5A. Each of the side rails 110A, 110B may be unlocked or released, via manual actuation of the knob 508, to unlock the locking structure 510 and allow movement of the side rail body 502 into a lowered position, depicted in FIG. 5B. In this embodiment, the side rail 110A, 110B does not lock in the lowered position. In other embodiments, the side rail 110A, 110B does lock in the lowered position or, optionally, in other positions.

Each of the side rails 110A, 110B is configured to automatically move into the lowered position when unlocked. In this embodiment, the center of gravity of the side rail body 502, weight and pivoting resistance of the side-rail supports 504 are selected to allow the side rail body 502 to move into the lowered position due to the influence of gravity. Thus, when a side rail 110A, 110B is in the raised position (FIG. 5A) and then unlocked, the side rail 110A, 110B tends to automatically fall into the lowered position (FIG. 5B) under its own weight.

Figure 6:
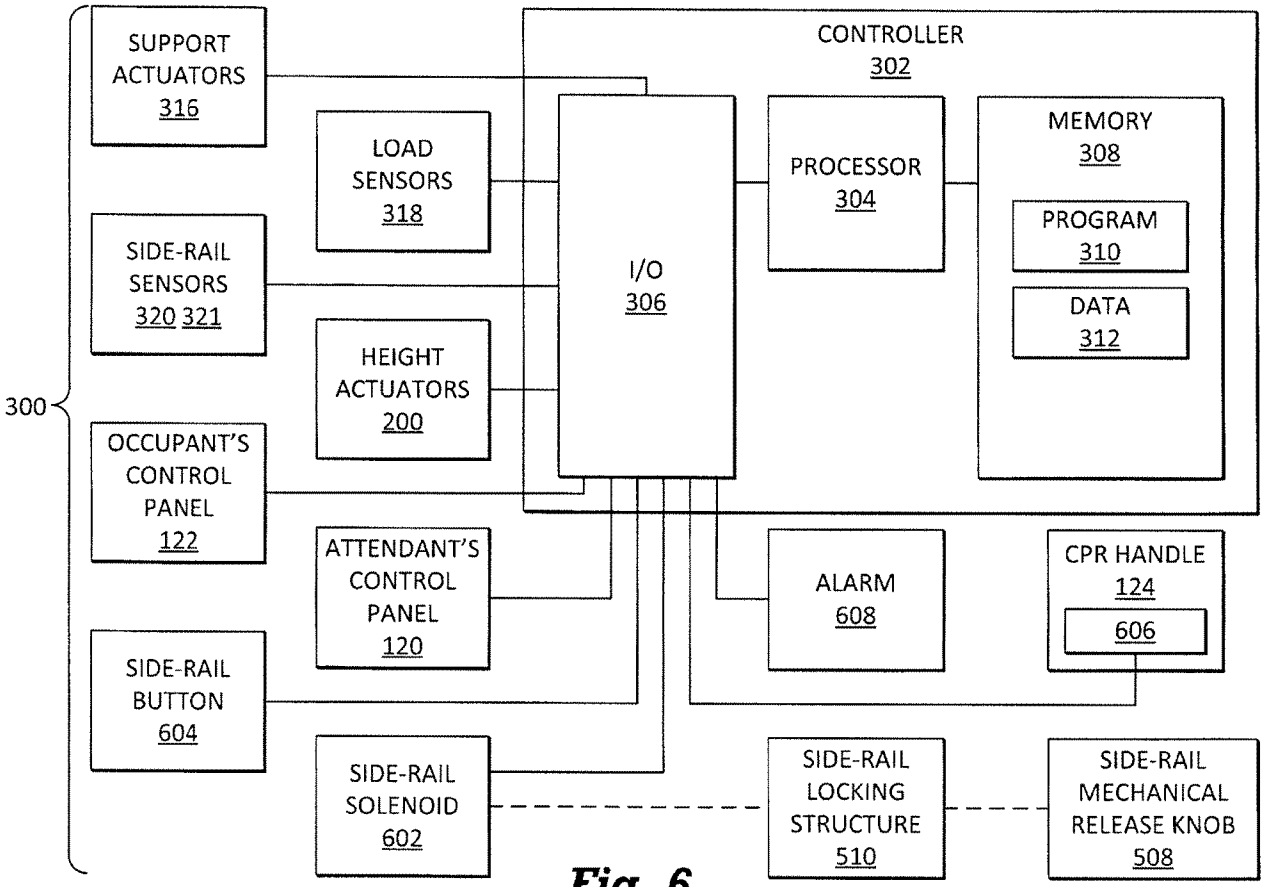
FIG. 6 is another functional block diagram of the system for controlling the patient support.

FIG. 6 shows another block diagram of the system 300 for controlling the patient support 100. Electrical couplings are shown by solid connecting lines and mechanical couplings are shown by dashed ones. In this embodiment, the system 300 further includes electromechanical actuators, for example side-rail unlocking solenoids 602, for unlocking the side rails 110A, 110B, or generally 110, and side-rail release buttons 604 for activating the solenoids 602. Although each side rail 110 is generally provided with one solenoid 602 and one button 604, the button 604 may be provided on the patient support remote from the side rail 110 or a single button 604 may be configured to actuate the release mechanism of a plurality of side rails 110.

Each side-rail unlocking solenoid 602 is electrically coupled to the input/output interface 306. The solenoid 602 may be double acting, spring biased in one direction, or of other design. The solenoid 602 is configured to electrically actuate and unlock the locking structure 510 upon activation of a switch via button 604. Alternative embodiments of electromechanical actuators may be used in place of the solenoid 602, for example linear actuators, etc.

Each side-rail release button 604 is electrically coupled to the input/output interface 306. The button 604 is connected to a switch, for example a momentary contact switch, and may form part of the occupant's control panel 122. The button 604 is positioned on an inside surface of the side rail 110 at a location that is readily accessible to the occupant of the patient support 100. In other embodiments, a handle, lever, or other device may be used to activate the switch instead of the button 604. A side rail release button similar to the button 604 may be provided in additional or alternative locations, for example on the outside of the side rail, the attendant's control panel, etc.

The side-rail locking structure 510 is configured to unlock upon electrical actuation of the release via button 604. The side-rail locking structure 510 is configured to mechanically unlock, as mentioned, upon mechanical actuation of the release via knob 508. Therefore, the button 604 is part of an electrical release and the knob 508 is part of a mechanical release. The electrical and mechanical releases together form a combined release that electrically and mechanically controls the locking structure 510. That is, in order to lower the side rail 110, an attendant may unlock the side rail 110 by pressing the knob 508 or may unlock the side rail 110 by pressing the button 604. The mechanical release may override the electrical release and permit the rail to be unlocked. It is advantageous that the same side-rail locking structure may be unlocked both mechanically and electrically; for example, in the event of power failure.

Side-rail release buttons 604 may be provided elsewhere on the patient support 100 to facilitate electrical unlocking of the side rails 110. For example, four side-rail release buttons 604, one for each side rail 110, may be provided at the attendant's control panel 120. A side rail release button 604 may be accessible to an occupant of the bed to electrically actuate the release and unlock the side rail to permit egress from the bed. This may be in addition to or as an alternative to buttons 604 provided for use by the caregiver or attendant.

The program 310 may be configured to control side-rail unlocking as follows.

The program 310 responds to predetermined input at the side-rail release buttons 604 in order to unlock the side rails 110. In one embodiment, three presses of one of the buttons 604 by an occupant of the bed in quick succession electrically actuates the release and unlocks the respective side rail 110. If the program 310 detects fewer than three presses in an allotted time, then the side rail 110 is not unlocked, while detection of three or more presses in the allotted time unlocks the side rail 110. This may advantageously prevent inadvertent unlocking of the side rails 110 by the occupant of the patient support 100.

The program 310 may be configured to lock out the side-rail release buttons 604. That is, the program 310 may ignore input at the buttons 604 under certain circumstances. For example, the attendant's control panel 120 may include a control lock out button that configures the program 310 to ignore commands received from the occupant of the patient support 100. This may be used when the safety of the occupant is a concern. Additional lockout states may include when the bed is in an unacceptable configuration, for example a Trendelenburg or reverse Trendelenburg orientation, when the backrest or knee is raised above an acceptable level, when a height of the bed is above or below an acceptable level, when a patient support surface or mattress is in an unacceptable orientation, when the caster wheels or brakes are unlocked, etc.

The program 310 may be configured to automatically electrically actuate the release and unlock any or all of the side-rail locking structures 510 using the respective solenoids 602 in the event that the CPR handle 124 is pulled, thereby putting the patient support in an emergency state. Each CPR handle 124 includes a switch 606 that indicates to the controller 302 that the CPR handle 124 has been pulled. Among other things, the switch 606 may provide the controller 302 with information on the state of the CPR handle 124, which the controller 302 may use, for example, to reset the emergency CPR mechanism. However, regarding the side rails 110, the program 310 may reference the state of each CPR handle switch 606 and accordingly control the solenoids 602 to unlock the side-rail locking structures 510 after one of the CPR handles 124 has been pulled. Which of the side rails 110 are to be so unlocked or the sequence in which they are unlocked may be predetermined. In one embodiment, only the two head-end side rails 110A are unlocked in an emergency state. In another embodiment, all of the side rails 110 are unlocked in this way. Electrically unlocking the side rails 110 during an emergency may advantageously allow the side rails to lower automatically, thereby permitting quicker and less complicated access to the occupant of the patient support 100. That is, emergency personnel do not need to first manually lower the side rails 110 before preforming procedures, such as chest compressions, that require unobstructed access to the occupant. Other actions may be taken by the controller 302 in an emergency state, for example flattening the patient support surface, triggering lights or alarms indicative of an emergency state, etc.

The program 310 may be configured to generate an alarm signal in response to unlocking of a side rail 110. In one embodiment, the alarm signal is generated when the release is electrically actuated. In another embodiment, each side rail 110 is provided with a side-rail locking sensor 320 that senses the locked/unlocked state of the side rail 110. The side-rail locking sensors 320 may comprise limit switches or similar devices. When the program 310 determines that a side rail 110 has been unlocked, the program 310 outputs the alarm signal to a device, such as an alarm device 608 on the patient support 100 or a remote monitoring device located at a nurse call station. The alarm device 608 may include one or more of an audible device, such as a speaker, and a visible device, such as a light or display. The alarm device 608 may further indicate which of the side rails 110 has been unlocked. For example, each side rail 110 may include a light-emitting diode (LED) that flashes when the side rail 110 is unlocked.

In another embodiment, still with reference to FIG. 6, the program 310 may be configured to adjust an allowable height of the frame 102 of the patient support 100 with reference to the side rails 110. Adjusting an allowable height based on the side rails 110 may reduce a patient falling hazard and/or may reduce the likelihood of damage to the patient support 100.

The program 310 constrains the height-adjusting actuators 200 to operate according to at least one actuation limit and provides an alarm signal to the alarm device 608 when the actuation limit is violated. The program 310 may establish one or more actuation limits corresponding to one or more of a maximum allowable height of the frame 102 and a minimum allowable height of the frame 102. An actuation limit corresponds to a position of an actuator 200 and may be stored and compared in terms, such as rotary encoder pulse count, that are different from terms (e.g., cm or inches) in which the corresponding allowable height is expressed. An allowable height is enforced by the program 310 ignoring commands that would cause one or more of the height-adjusting actuators 200 to violate an actuation limit. Default maximum and minimum allowable heights may be used to stop the actuators 200 during normal raising and lowering of the patient support 100.

The system 300 may additionally or alternatively include side-rail position sensors 321 that are electrically coupled to the input/output interface 306. Each side-rail position sensor 321 is configured to detect a position of the side rail 110, for example whether the respective side rail 110 is in the raised position, the lowered position, or optionally another position. The side-rail position sensors 321 may be limit switches, proximity sensors, optical sensors or similar devices.

The program 310 may reference one or more of the side-rail locking sensors 320 and side-rail position sensors 321 to determine whether an allowable height of the patient support 100 is to be adjusted. Each kind of sensor 320, 321 may indicate to the program 310 that the patient support 100 should not be raised or lowered beyond an allowable height. Other features of the patient support 100, such as bed configuration, may be controlled based on input from the sensors 320 and/or 321; for example the bed may be prevented from entering a Trendelenburg or reverse Trendelenburg orientation, the backrest or knee may be prevented from being raised above an acceptable level, a height of the bed may be prevented from being adjusted outside of an acceptable range, a patient support surface or mattress may be prevented from entering an unacceptable orientation, the caster wheels or brakes may be prevented from being unlocked, etc.

The program 310 may be configured to lower the maximum allowable height of the frame 102 when a side rail 110 is unlocked, as determined by the respective side-rail locking sensor 320, or when a side rail 110 is lowered, as determined by the respective side-rail position sensor 321. When a side rail 110 is unlocked or lowered, the program 310 ignores commands that would cause the frame 102 to be raised higher than the maximum allowable height. When the program 310 determines that the frame 102 is higher than the maximum allowable height, as may be the case when a side rail 110 is unlocked or lowered after the frame 102 has been raised, then the program 310 outputs an alarm via the alarm device 608. This may advantageously help reduce injury if the occupant were to fall from the patient support 100.

In a numerical example, the default maximum allowable height is 91 cm (or 36 inches) and the maximum allowable height with an unlocked or lowered side rail 110 is 61 cm (or 24 inches). The patient support 100 may be raised and lowered below 61 cm irrespective of the side rails 110 being locked/unlocked or raised/lowered. If a side rail 110 is unlocked or lowered and an attempt is made to raise the patient support 100 above 61 cm, then the program 310 ignores the raise command. If the patient support is already above 61 cm when a side rail 110 is unlocked or lowered, then the program 310 issues an alarm and also ignores raise commands.

The program 310 may be configured to raise the minimum allowable height of the frame 102 when a side rail 110 is unlocked, as determined by the respective side-rail locking sensor 320, or when a side rail 110 is lowered, as determined by the respective side-rail position sensor 321. When a side rail 110 is unlocked or lowered, the program 310 ignores commands that would cause the frame 102 to be lowered lower than the minimum allowable height. When the program 310 determines that the frame 102 is lower than the minimum allowable height, as may be the case when a side rail 110 is unlocked or lowered after the frame 102 has been lowered, then the program 310 outputs an alarm via the alarm device 608. This may advantageously help prevent damage to the side rails 110 or objects on the floor underneath the side rails 110.

In a numerical example, the default minimum allowable height is 15 cm (or 6 inches) and the minimum allowable height with an unlocked or lowered side rail 110 is 20 cm (or 8 inches) or other increased amount sufficient to prevent interference between the side rails 110 and the floor. The patient support 100 may be raised and lowered above 20 cm irrespective of the side rails 110 being locked/unlocked or raised/lowered. If a side rail 110 is unlocked or lowered and an attempt is made to lower the patient support 100 below 20 cm, then the program 310 ignores the lower command. If the patient support is already below 20 cm when a side rail 110 is unlocked or lowered, then the program 310 issues an alarm and also ignores lower commands.

The features of the program 310 described in the embodiments above, and specifically the features regarding electrical unlocking of side rails 110, such as control lock out, CPR unlocking, alarms, and allowable height adjustments, may be used independently of each other and may be used together in any suitable combination.

As may be seen from the figures, the mechanical release action of the locking structure 510 may override the electrical release action of the locking structure 510. That is, in some situations, such as power failure, the solenoid 602 may not be used to unlock the side rail 110. However, in such situations, the knob 508 may always be pushed to unlock the side rail 110. Another example of such a situation is a control lock out that disables the side-rail release button 604 and thus disables electrical unlocking of the side rail 110. Again, the knob 508 may be pushed to unlock the side rail 110. This is advantageous in that the side rails 110 may always be lowered during an emergency, regardless of the state of electrical power at the patient support 100, while still providing convenience via electrical side rail unlocking when power is available.

Figure 7A:
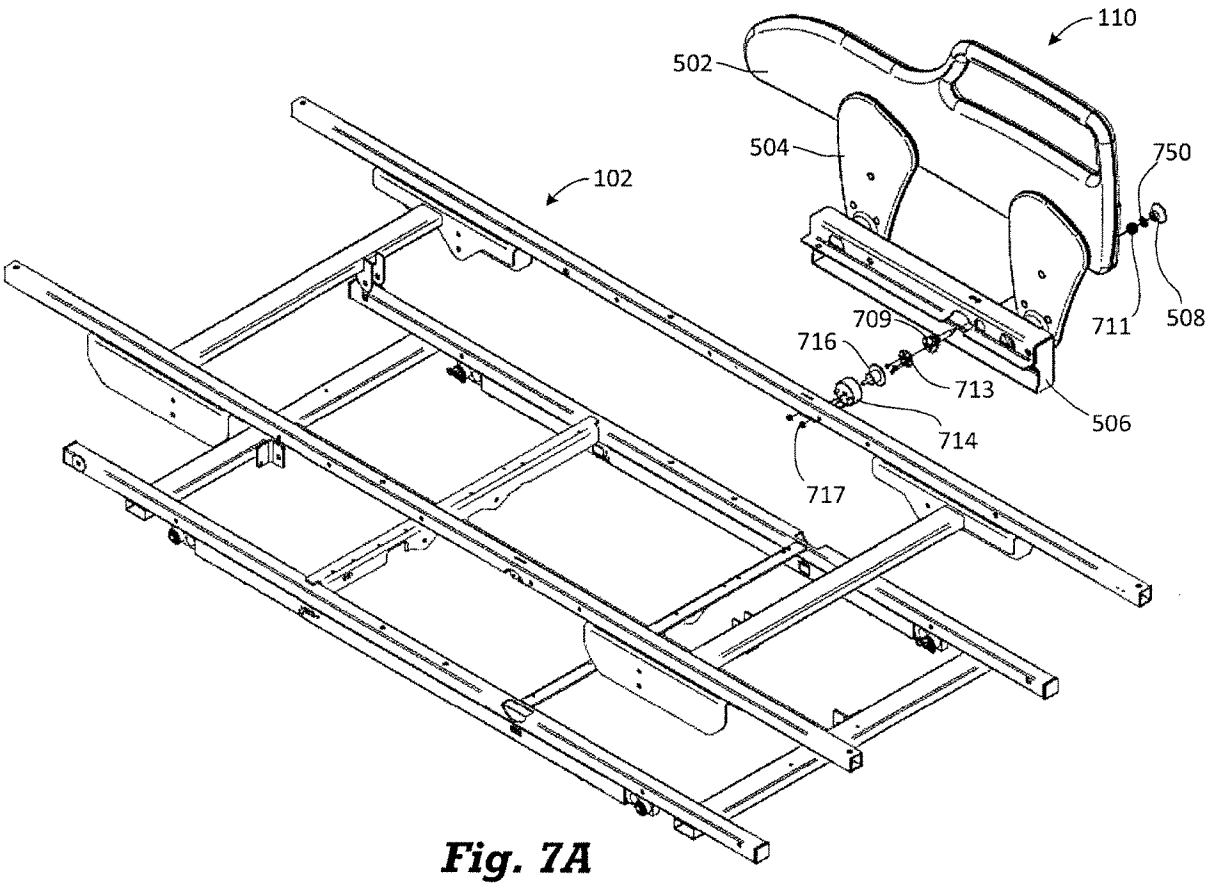
FIG. 7A is an exploded view of a side rail attached to a side of a frame of a patient support.

Referring to FIG. 7A, a side rail 110 is mounted to a side of a frame 102 of a patient support 100. The side rail 110 is depicted in a raised position and shows various components of the locking mechanism and release in exploded view. The release shown is configured to be both mechanically and electrically actuated, in a manner as will be more fully described hereinafter.

Figure 7B:
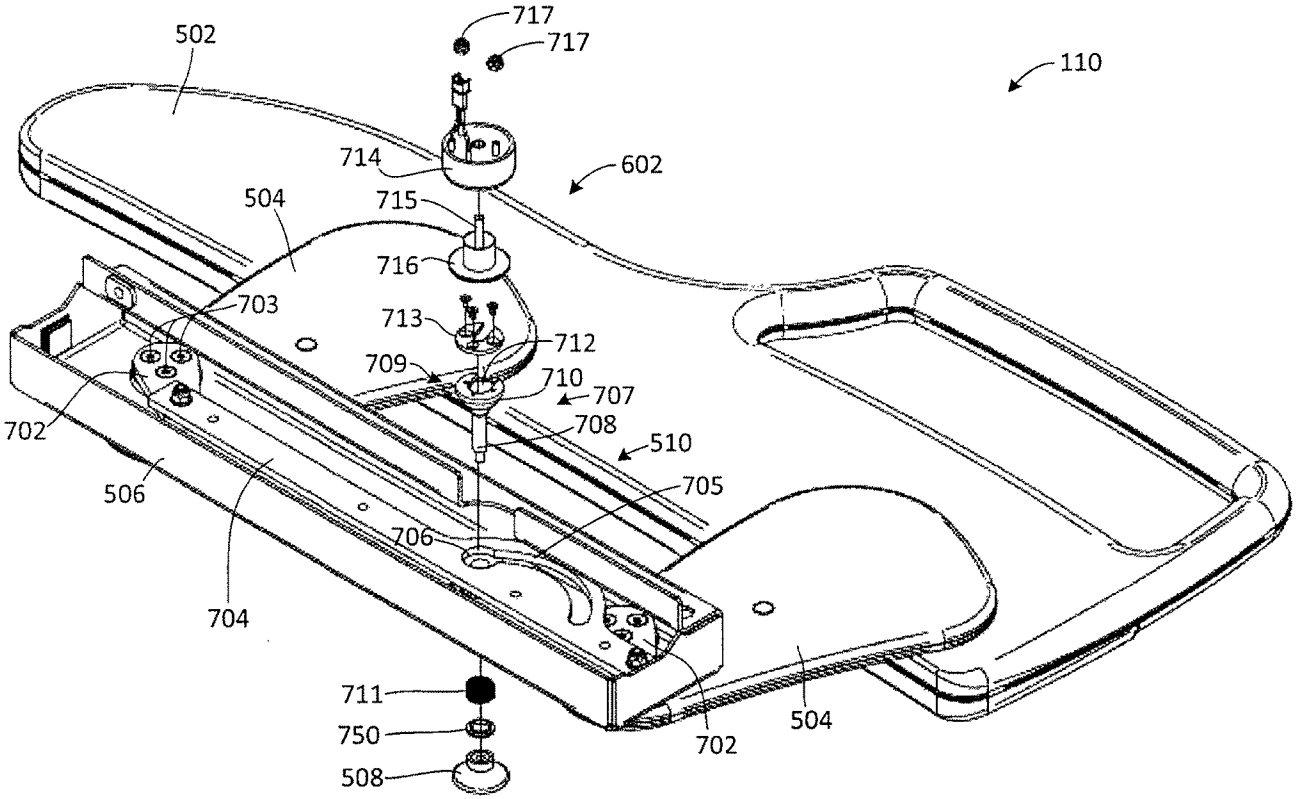
FIG. 7B is a an enlarged exploded view of the side rail of FIG. 7A.

Turning to FIG. 7B, the side rail 110 comprises a side rail body 502 pivotally connected to the upper end of two side rail supports 504 as previously described. The side rail supports 504 are pivotally connected at their lower end to the housing 506 that is used to mount the side rail to the frame 102 or backrest 105. Inside the housing 506 are a pair of lobe shaped members 702 that are fixedly attached to a shaft (not shown) extended through the housing 506 at the point of pivotal connection of the side rail supports 504 to the housing 506. For reference, the shaft (not shown) is attached to each lobe shaped member at about the center of the triangle formed by the three screws 703. The lobe shaped members 702 therefore move with the side rail supports 504 upon pivoting movement of the side rail body 502.

Pivotally attached to the outward end of each lobe shaped member 702 is a side rail cross-bar 704 that completes a second four-bar linkage of the siderail 110. The cross-bar 704 includes an arcuate slot 705 with an enlarged circular aperture 706 at one end thereof. A locking pin 707 comprises an elongate pin shaft 708 that is threaded at one end and comprises an enlarged pin head 709 at the other. The pin head 709 includes a shoulder 710 with a diameter corresponding to that of the aperture 706. When locked, the shoulder 710 of the locking pin 707 rests within the aperture 706. Since the shoulder 710 is larger in size than the arcuate slot 705, movement of the cross-bar 704 is prevented, which concurrently prevents pivoting movement of the rail body due to the action of the second four-bar linkage. When unlocked through actuation of a release, in a manner as will be more thoroughly described hereinafter, the locking pin 707 moves longitudinally towards the frame 102 (upward in the orientation of FIG. 7B) so that the shoulder 710 disengages from the aperture 706. The relatively smaller first diameter of the pin shaft 708 corresponds in size to the arcuate slot 705, thereby permitting movement of the cross bar 704 and concurrently permitting movement of the side rail body 502.

A spring 711 forms part of the mechanical release and biases the locking pin 707 outwardly, away from the frame (toward the cross bar 704). A knob 508 for manual actuation of the mechanical release (via pushing towards the frame 102) is threaded to the end of the pin shaft 708. A washer 750 is provided to enlarge the surface for engagement of the spring 711 with the knob 508. When unlocked, the shoulder 710 is able to ride along the outside edge of the arcuate slot 705 during lowering of the side rail 110 (represented by movement of the rail body to the right in FIG. 7B), thereby keeping the side rail 110 in an unlocked state. When the side rail 110 is raised, the shoulder 710 eventually encounters the aperture 706 and snaps into engagement therewith due to the action of the spring 711. This locks the rail in the raised position, preventing further movement. Therefore, the arcuate slot 705, circular aperture 706 and locking pin 707 together form a locking structure 510 that is configured to lock the rail in the raised position, but permits the rail to be unlocked and free to move when in other positions.

Figure 8A:
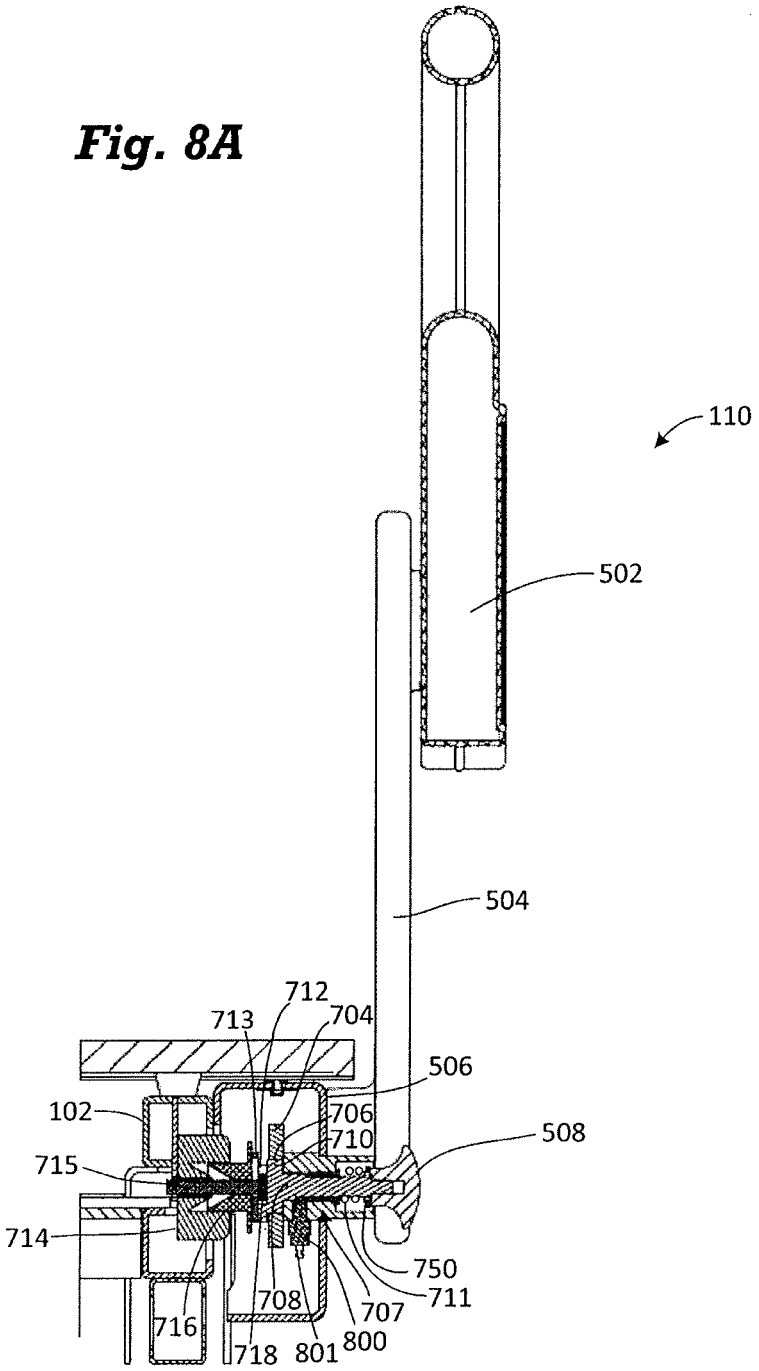
FIG. 8A is a cross-sectional view of a locking mechanism and release of a side rail in a raised position.
Figure 8B:
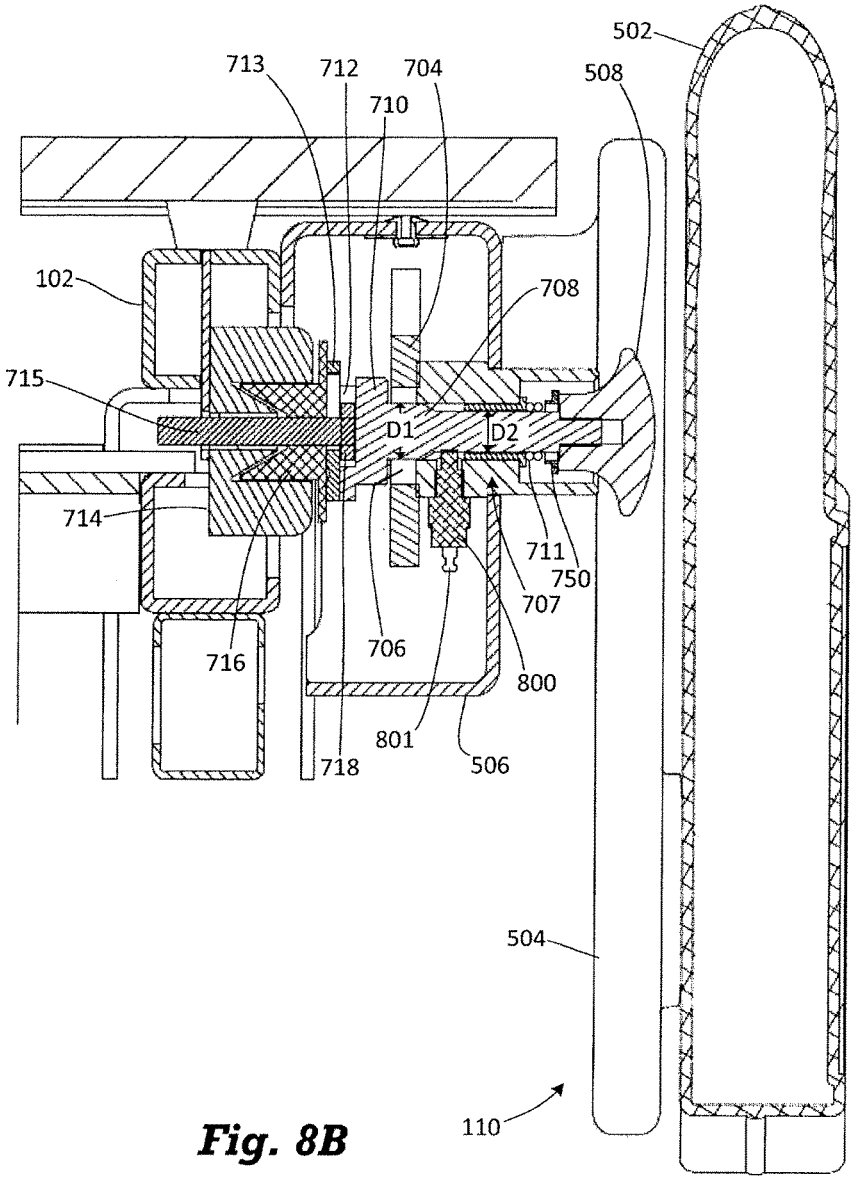
FIG. 8B is a cross-sectional view of the locking mechanism and release of the side rail of FIG. 8A in a lowered position.

The pin head 709 comprises a U shaped slot 712. A capture plate 713 with a smaller U shaped slot is mounted to the pin head 709. A reciprocating electromechanical actuator in the form of a solenoid 602 comprises a solenoid actuator 714 with a solenoid shaft 715 secured for reciprocating movement therethrough by a solenoid cover plate 716 attached to the actuator 714 by a pair of mounting bolts and corresponding nuts 717. Referring additionally to FIGS. 8A-B, the solenoid shaft 715 has a diameter corresponding to the U shaped slot of the capture plate 713 and includes an enlarged solenoid shaft head 718 with a diameter roughly corresponding to that of the U shaped slot 712. The capture plate therefore prevents the solenoid shaft head 718 from escaping the U shaped slot 712, thereby longitudinally securing the solenoid shaft 715 to the pin head 709 while at the same time permitting some misalignment between the longitudinal axes of the solenoid shaft 715 and the pin shaft 708. This is important in that the solenoid 602 is mounted to the frame 102 separately from the side rail 110 and some misalignment due to manufacturing tolerances is to be expected.

Referring to FIG. 8A, when the side rail 110 is raised, the shoulder 710 rests within the aperture 706, preventing movement of the side rail 110. Turning to FIG. 8B, the side rail 110 is depicted in an unlocked state, achieved either by mechanical actuation of the release (by pushing the knob 508 inwardly towards the frame 102), or by electrical actuation of the release via the solenoid 602. Energizing the solenoid actuator 714 causes the solenoid shaft 715 to move inwardly towards the frame 102, drawing on the pin head 709 by virtue of the capturing of the solenoid shaft head 718 within the U shaped slot 712 by the capture plate 713. This causes the shoulder 710 to disengage from the apertures 706, permitting pivoting movement of the side rail 110. It should be noted that the spring 711 acts to bias both the locking pin 707 and the connected solenoid shaft 715 outwardly of the frame towards the cross bar 704. Therefore, overcoming the spring 711 by manually pushing on the knob 508 overrides the electrical actuation (or non-actuation) of the release. This is advantageous in that, in the event of power outage or solenoid failure, the side rail 110 can still be mechanically unlocked to permit lowering.

Still referring to FIGS. 8A-B, in the embodiment shown the pin shaft 708 has a slight variation in diameter along its length. The first diameter D1of the pin shaft 708 corresponds to the arcuate slot and is slightly larger in size than the second diameter D2 of the pin shaft. A chamfered transition connects the two diameters. A locking sensor 800 comprises a longitudinally translatable plunger 801 oriented at right angles to the pin shaft 708. When the locking pin 707 is in the locked position shown in FIG. 8A, the plunger 801 is depressed by the larger diameter D1 of the pin shaft 708, thereby closing a limit switch (not shown) located within the sensor 800 and connected to the plunger 801. When the locking pin 707 is in the unlocked position shown in FIG. 8B, the plunger 801 is biased outwardly toward the smaller diameter D2, thereby opening the limit switch within the sensor 800. The locking sensor 800 is thereby able to detect the locking state of the locking structure and to provide a signal indicative of the locking state to the controller.

Figure 9A:
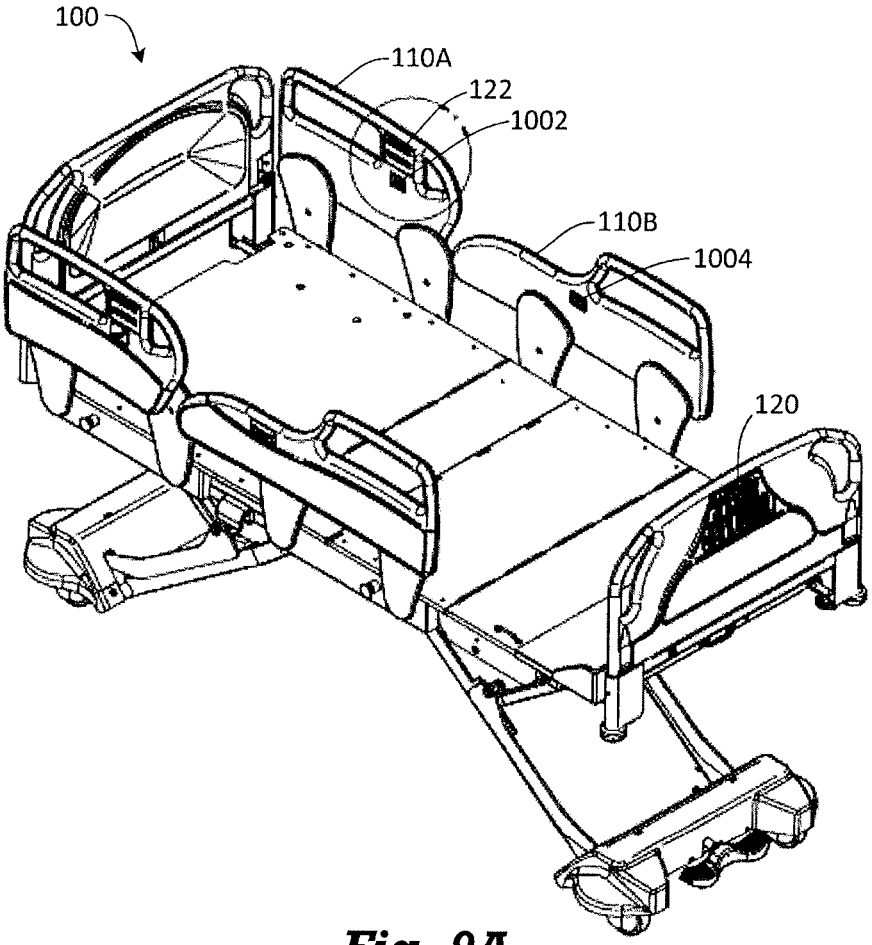
FIG. 9A is a perspective view of the patient support showing locations for side rail releases.
Figure 9B:
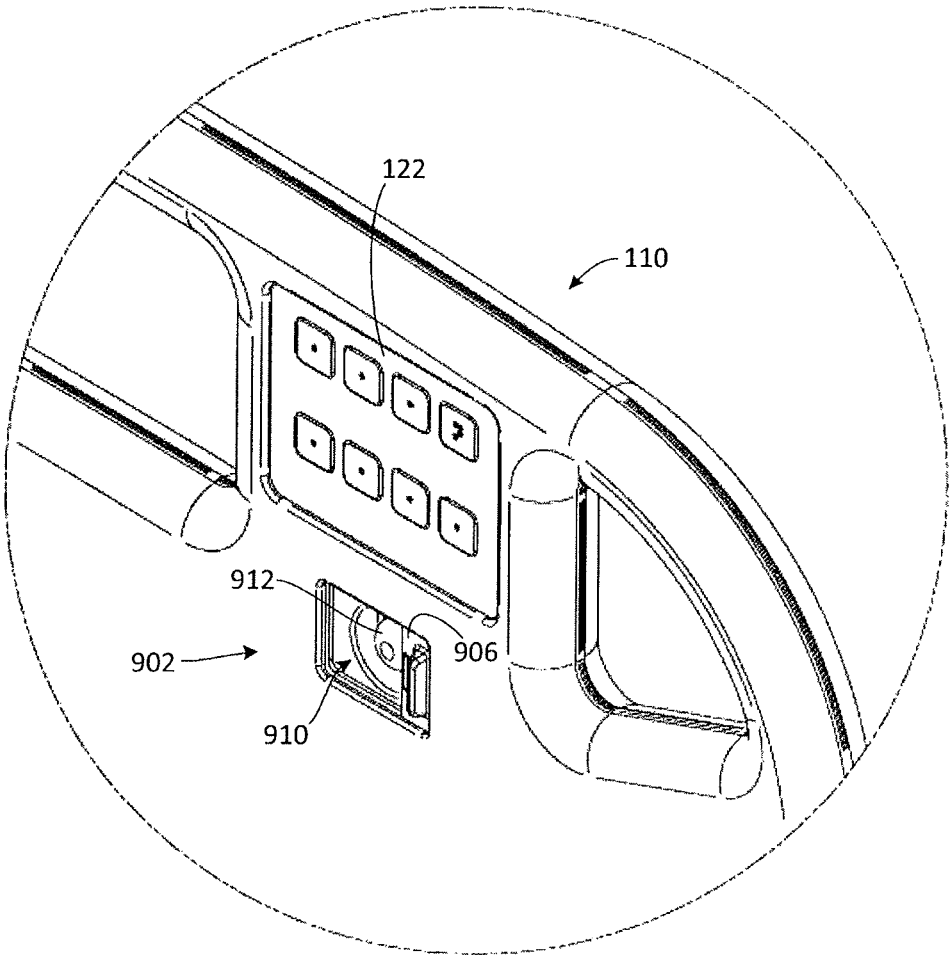
FIG. 9B is a perspective view of a portion of a side rail showing a release access port.

Referring to FIG. 9B, the release access port 902 includes a port aperture 910 and a port cover 906. Inside the port aperture 910 is an actuatable button 912 that is only accessible to the occupant of the patient support 100 through the port aperture 910 when the port cover 906 is opened. In other embodiments, rather than the button 912, a handle or lever may be located inside the port aperture 910.

The port cover 906 slides across the aperture 910, for example horizontally, and is resiliently biased to close. Therefore, the port cover 906 is held open by the occupant with one hand while the button 912 is pressed to actuate the release. In a variation of this embodiment, the port cover 906 may temporarily lock in the open position and be released once the button 912 is pressed. In either case, the port cover 906 automatically closes following actuation of the release.

FIG. 9A shows locations 1002, 1004 for releases discussed herein, such as the button 604 of FIG. 6 and the release access port 902 of FIG. 9AB. As may be seen, the location 1002 is on the inside of the head-end side rail 110A and the location 1004 is on the inside of the foot-end side rail 110B. The locations 1002, 1004 are readily accessible to the occupant of the patient support when the side rail 110 is raised and locked. The release may be a mechanical release similar to the one comprising the knob 508 or may be an electrical release similar to the one comprising the button 604. The release may include a release access port 902 that is located on an inside surface 904 of the side rail 110 that the release unlocks. Alternatively, the release access port 902 may be located on an inside surface 904 of a side rail 110 other than the side rail 110 that the release unlocks; for example, the access port 902 may be located on an inside surface 904 of a head-end side rail, but the release unlocks a foot-end side rail. Releases may also be provided at the occupant's control panel 122 and the attendant's control panel 120.

While the foregoing provides certain non-limiting example embodiments, it should be understood that combinations, subsets, and variations of the foregoing are contemplated. The monopoly sought is defined by the claims.

What is claimed is:

1. A guard structure configured to couple to a patient support, the guard structure having a vertical orientation and being movable between a raised position and a lowered position, the guard structure maintaining the vertical orientation when in the raised position and when in the lowered position, the guard structure comprising a locking structure configured to lock the guard structure in the raised position and configured to unlock through actuation of a release for vertical movement of the guard structure to the lowered position such that the guard structure maintains the vertical orientation upon moving between the raised position and lowered position, the release accessible to an occupant of the patient support and configured to prevent inadvertent actuation by the occupant, and the release being configured for both independent mechanical actuation and electrical actuation.

2. The guard structure according to claim 1, wherein the guard structure further comprises a release access port, the release being accessible to the occupant only when the release access port is opened.

3. The guard structure of claim 2, wherein the release access port automatically closes when not held open.

4. The guard structure of claim 2, wherein the guard structure includes a first side for facing the patient support and a second side for facing outwardly from the patient support, the release located at said first side wherein an occupant of the patient support can access the release while the occupant patient is in a supine position on the patient support.

5. The guard structure of claim 1, wherein the mechanical actuation of the release is configured to override the electrical actuation of the release.

6. The guard structure of claim 1, wherein the release comprises an electromechanical actuator configured to unlock the locking structure upon electrical actuation of the release.

7. The guard structure of claim 1, wherein the release is configured to prevent inadvertent actuation by the occupant by requiring at least three consecutive electrical actuation signals to be delivered by the occupant to the release prior to electrical actuation of the release.

8. The guard structure of claim 1, wherein actuation of the release causes an alarm signal to be generated.

9. The guard structure of claim 1, wherein the locking structure is configured to lock the guard structure in the raised position to prevent the guard structure from moving to the lowered position, and wherein the locking structure is configured to unlock through actuation of the release whereby the unlocking permits the guard structure to move from the raised position to the lowered position.

10. A guard structure configured to couple to a patient support, the guard structure having a vertical orientation and being movable between a raised position and a lowered position, the guard structure maintaining the vertical orientation when in the raised position and when in the lowered position, the guard structure comprising a locking structure configured to lock the guard structure in the raised position and configured to unlock through actuation of a release for vertical movement of the guard structure to the lowered position, the release configured for both independent mechanical actuation and electrical actuation.

11. The guard structure of claim 10, wherein the mechanical actuation of the release is configured to override the electrical actuation of the release.

12. The guard structure of claim 10, wherein the release comprises an electromechanical actuator configured to unlock the locking structure upon electrical actuation of the release.

13. The guard structure of claim 10, wherein the release is automatically actuated when the patient support is in an emergency state initiated by an emergency mechanism of the patient support.

14. The guard structure of claim 10, wherein unlocking of the guard structure causes an alarm signal to be generated.

15. The guard structure of claim 10, wherein the release is on the guard structure.

16. The guard structure of claim 10, wherein the electrical actuation of the release causes the locking structure to unlock independently of the mechanical actuation of the release.

17. A patient support comprising: a height adjustable frame supported by a floor; and a guard structure coupled to the frame, the guard structure movable between a raised position and a lowered position, the guard structure comprising a locking structure configured to lock the guard structure in the raised position and configured to unlock through actuation of a release, wherein the patient support further comprises an emergency mechanism configured to place the patient support into an emergency state wherein a patient support deck of the patient support is flat and wherein the release is electrically actuated.

18. The patient support according to claim 17, wherein the guard structure is configured to automatically move into the lowered position when unlocked.

19. The patient support according to claim 18, wherein the release comprises an electromechanical actuator configured to unlock the locking structure upon electrical actuation of the release.

* * * * *